US005794691A

United States Patent [19]

Evans et al.

[11] Patent Number: 5,794,691

[45] Date of Patent: Aug. 18, 1998

[54] PLATE HEAT EXCHANGER WITH REINFORCED INPUT/OUTPUT MANIFOLDS

[75] Inventors: Bruce Laurance Evans, Burlington; James Gerrard Sorensen, Georgetown; Brian Ernest Duke, Carlisle, all of Canada

[73] Assignee: Long Manufacturing Ltd., Oakville, Canada

[21] Appl. No.: 779,313

[22] Filed: Jan. 6, 1997

[51] Int. Cl.[6] ..... F28D 1/03

[52] U.S. Cl. ..... 165/153; 165/167; 165/170; 165/906

[58] Field of Search ..... 165/153, 167, 165/170, 906, 175

[56] References Cited

U.S. PATENT DOCUMENTS

| | | | |
|---|---|---|---|
| 2,287,281 | 6/1942 | Thomas . | |
| 4,229,868 | 10/1980 | Kretzinger . | |
| 4,291,754 | 9/1981 | Morse et al. . | |
| 4,470,455 | 9/1984 | Sacca . | |
| 4,987,955 | 1/1991 | Bergqvist et al. | 165/167 |
| 5,538,077 | 7/1996 | So et al. | 165/153 X |

FOREIGN PATENT DOCUMENTS

| | | | |
|---|---|---|---|
| 1353580 | 1/1964 | France | 165/153 |
| 2 280 871 | 2/1976 | France . | |
| 1 928 146 | 12/1969 | United Kingdom . | |
| 2 026 676 | 2/1980 | United Kingdom . | |

*Primary Examiner*—Leonard R. Leo
*Attorney, Agent, or Firm*—Barrigar & Moss

[57] ABSTRACT

A plate type heat exchanger as disclosed having a plurality of stacked plate pairs. Each plate pair has opposed inlet and outlet openings that are in registration to form respective inlet and outlet flow manifolds for the flow of fluid through the plate pairs. Each of the inlet and outlet openings has an inner peripheral edge portion including opposed, flange segments extending inwardly and being joined together to prevent expansion of the manifolds under pressure.

10 Claims, 3 Drawing Sheets

PLATE HEAT EXCHANGER WITH REINFORCED INPUT/OUTPUT MANIFOLDS

BACKGROUND OF THE INVENTION

This invention relates to stacked plate heat exchangers as used particularly in the automotive industry.

Stacked plate heat exchangers produced in the past typically comprise a plurality of plate pairs piled one on top of the other, with each plate pair having opposed inlet and outlet openings located in the same relative position. In the stack of plate pairs, all of the inlet openings are aligned and in communication to feed the fluid to be cooled or heated by the heat exchanger through the internal passages of each plate pair. Similarly, all of the outlet openings are aligned and in communication to receive the fluid passing through the plate pairs and deliver it to the outlet of the heat exchanger.

The plate pairs are usually joined together, such as by brazing. However, in the areas of the inlet and outlet openings, there is often very little material for joining the plates together, with the result that the shape of the heat exchanger tends to distort under the pressure of the fluid therein. In other words, the area of the heat exchanger near the inlet and outlet openings tends to expand like an accordion or bellows and this leads to premature failure or leaking in the heat exchanger.

Attempts have been made in the past to reinforce the inlet and outlet areas of the heat exchanger. One approach is to use exterior clamps or brackets or strips of metal brazed to the outside of the heat exchanger to keep it from expanding under pressure. Another approach is to locate reinforcing rings or spacers around the peripheral edges of the inlet and outlet openings of each plate, and braze all of these rings or spacers and plates together. Yet another approach is to insert perforated or slotted tubes through all of the aligned inlet and outlet openings, the tubes being brazed to the peripheries of the respective inlet and outlet openings.

A difficulty with the prior art attempts to reinforce the inlet and outlet areas of the heat exchanger is that the additional components required give rise to production problems in making the heat exchangers. The additional components are difficult to assemble and retain in position during the brazing process. The additional components also add to the cost of the heat exchangers.

In the present invention, the peripheral edges of the inlet and outlet openings have integral, inwardly disposed, joined flange segments to reinforce the inlet and outlet areas of the heat exchanger, so no additional components are required.

BRIEF SUMMARY OF THE INVENTION

According to the invention, there is provided a heat exchanger comprising a plurality of stacked plates arranged in face-to-face pairs. Each of said face-to-face pairs includes first and second plates, the first plate having a planar central portion, a lower peripheral co-planar edge portion extending below the central portion, and space-apart co-planar end bosses extending above the central portion. The second plate of each face-to-face plate pair has a peripheral edge portion joined to the first plate peripheral edge portion, a central portion spaced from the first plate central portion, and spaced-apart co-planar end bosses extending below the second plate central portion. The second plate of one plate pair is located back-to-back with a first plate of an adjacent plate pair, the respective end bosses being joined together. The end bosses define inlet and outlet openings in registration, so that in a stack of back-to-back plate pairs, all inlet openings are in alignment and all outlet openings are in alignment forming respective inlet and outlet manifolds, the openings having inner peripheral edge portions. Also, the inner peripheral edge portions at the inlet and outlet openings of each plate pair include opposed, flange segments extending inwardly which are joined together.

BRIEF DESCRIPTION OF THE DRAWINGS

Preferred embodiments of the invention will now be described, by way of example, with reference to the accompanying drawings, in which.

DESCRIPTION OF THE PREFERRED EMBODIMENTS

Figure 1:
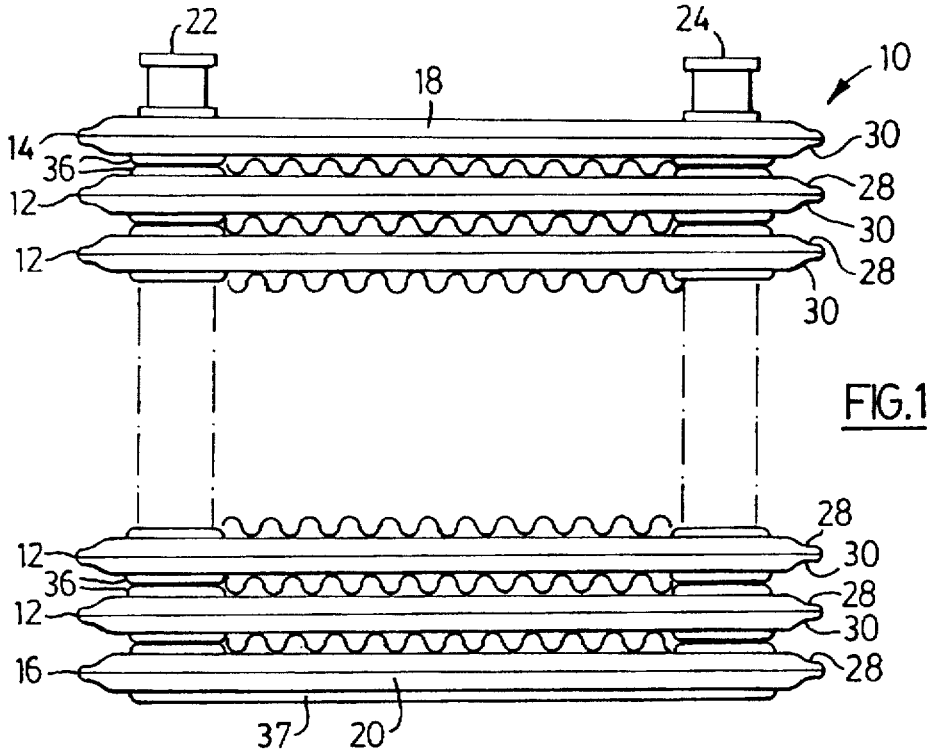
FIG. 1 is an elevational view of a preferred embodiment of a stacked plate heat exchanger according to the present invention.
Figure 2:
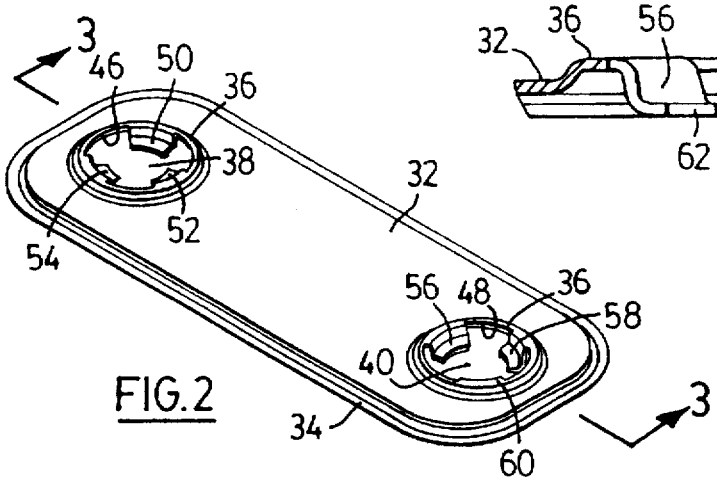
FIG. 2 is a perspective view of one of the plates of each plate pair of the stacked plate heat exchanger of FIG. 1.
Figure 5:
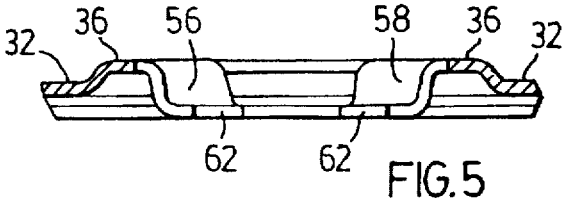
FIG. 5 is a partial sectional view taken along lines 5—5 of FIG. 4.
Figure 3:
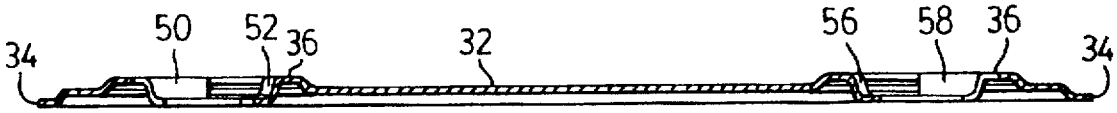
FIG. 3 is a sectional view taken along lines 3—3 of FIG. 2.
Figure 4:
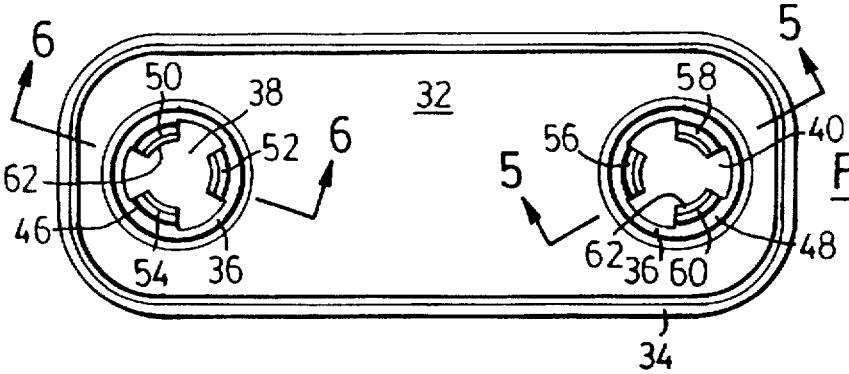
FIG. 4 is a plan view of the plate shown in FIG. 2.

Referring firstly to FIGS. 1 to 6, a preferred embodiment of a plate type heat exchanger according to the present invention is generally indicated by reference numeral 10 in FIG. 1. Heat exchanger 10 is formed of a plurality of plate pairs 12, a top plate pair 14; and a bottom plate pair 16. All of the plates of plate pairs 12 are identical and as shown in FIGS. 2 to 6. Heat exchanger 10 also has an inlet nipple 22 and an outlet nipple 24 for the flow of fluid through the plate pairs 12, 14 and 16.

The face-to-face, stacked plate pairs 12 each include first and second plates 28, 30. First plates 28 have a planar central portion 32, a lower peripheral co-planar edge portion 34 extending below the central portion 32, and spaced-apart co-planar end bosses 36 extending above the central portion 32.

The second plate 30 of each plate pair is identical to first plate 28 but turned upside down. Each second plate has a peripheral edge portion 34 joined to the first plate peripheral edge portion 34, a central portion 32 spaced from the first plate central portion, and spaced-apart co-planar end bosses 36 extending below the second plate central portion 32. For the purposes of this disclosure, the terms "below" and "above" with reference to peripheral edge portion 34 and end bosses 36 of first plates 28 would, of course, be reversed with reference to peripheral edge portion 34 and end bosses 36 of second plate 30.

The second plate 30 of each plate pair 12 is located back-to-back with a first plate 28 of an adjacent plate pair 12, with the respective end bosses 36 being joined together, such as by brazing.

The end boss 36 on one end of each plate defines an inlet opening 38 and the end boss on the opposite end of each plate defines an outlet opening 40. All of the inlet openings 38 in all of the plates are in registration or alignment, and all of the outlet openings 40 in all of the plates are in registration or alignment, so that in a stack of back-to-back plate pairs, all inlet openings 38 are in alignment and all outlet openings 40 are in alignment forming respective inlet and outlet manifolds 42, 44 (see FIG. 9).

Top plate pair 14 does not have end bosses 36, but has a smooth top plate 18 defining openings 26 (see FIG. 6) located below nipples 22,24 for the flow of fluid into and out of manifolds 42,44. Bottom plate pair 16 also does not have end bosses 36, but has a smooth lower plate 20. A bottom plate 37 on heat exchanger 10 prevents fluid from flowing out of the lower ends of manifolds 42,44. The second or bottom plate 30 of top plate pair 14 and the first or top plate 28 of bottom plate pair 16 are also identical to plates 28, 30 of plate pairs 12. If desired, top and bottom plates 18, 20 could be replaced by plates which are identical to plates 28, 30, provided alternate means or a separate bottom plate 37 is used to plug or cover inlet and outlet openings 38,40.

Each inlet opening 38 has an inner peripheral edge portion 46, and each outlet opening 40 has an inner peripheral edge portion 48. Inner peripheral edge portion 46 has three, equi-spaced, circumferentially spaced-apart flange segments 50, 52, 54, and inner peripheral edge portion 48 has three equi-spaced, circumferentially spaced-apart flange segments 56, 58, 60. As seen best in FIG. 6, the flange segments extend inwardly to the interior of the plate pairs and are joined together to reinforce or strengthen the inlet and outlet manifolds.

Figure 7:
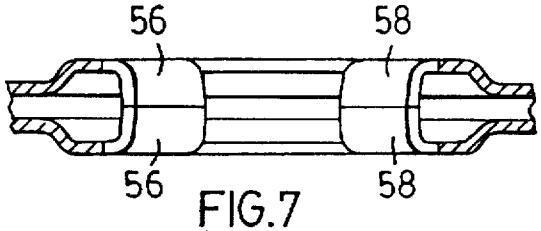
FIG. 7 is a view similar to FIG. 5, but showing mating plates and also showing another embodiment of the opposed, joined flange segments.
Figure 8:
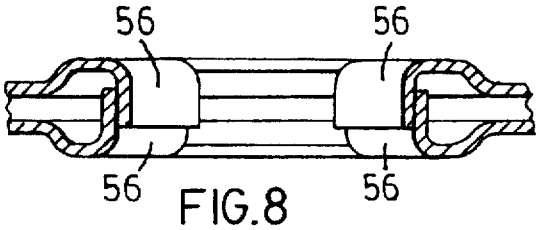
FIG. 8 is a view similar to FIG. 7, but showing yet another embodiment of the opposed, joined flange segments.

In the embodiment shown in FIGS. 2 to 6, flange segments 50 to 56 have radially disposed overlapping end portions 62 (see FIG. 5) to provide a little extra surface contact area to improve the strength of the joint therebetween. In the embodiment shown in FIG. 7, the flange segments are joined together in a butt joint. In the embodiment shown in FIG. 8, the flange segments are joined together by being axially overlapped. The FIG. 7 embodiment is a little less strong than the FIG. 5 embodiment. The FIG. 8 embodiment is the strongest embodiment, but depending on the thickness of the material used to make the plates, it may be necessary to make male and female plates, rather than making all of the plates identical in order to make the flange segments mate as shown.

Figure 10:
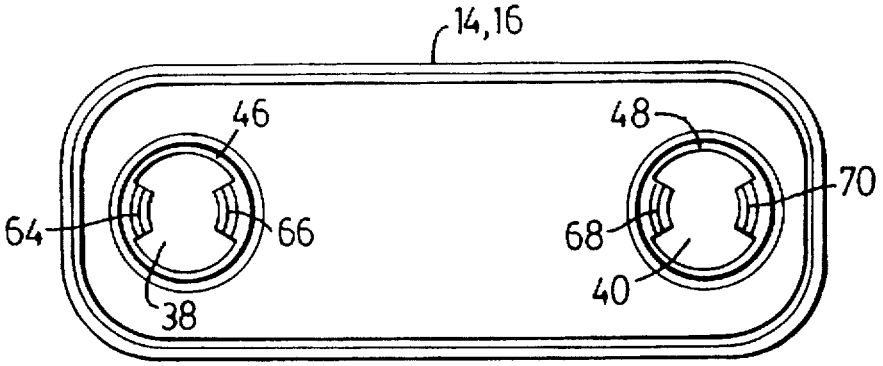
FIGS. 10, 11 and 12 are plan views of plates similar to FIG. 4, but showing different configurations of the flange segments.

Referring next to FIG. 10, a modification for the plates 14, 16 is shown wherein the inner peripheral edge portion 46 has two diametrically opposed flange segments 64, 66 and inner peripheral edge portion 48 has two diametrically opposed flange segments 68, 70. In this embodiment, flange segments 64 to 70 produce a minimal restriction to the flow of fluid from inlet opening 38 to outlet opening 40.

Figure 11:
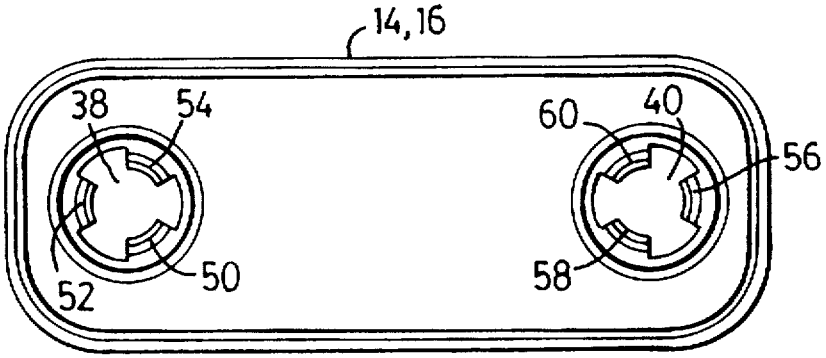

The embodiment shown in FIG. 11 is similar to the embodiment shown in FIGS. 2 to 6, but the position of the flange segments has been rotated by 180 degrees. This embodiment provides more flow restriction for the flow of fluid from inlet opening 38 to outlet opening 40 than the embodiment shown in FIG. 4, the embodiment shown in FIG. 4 providing more flow restriction than in the embodiment shown in FIG. 10.

Figure 12:
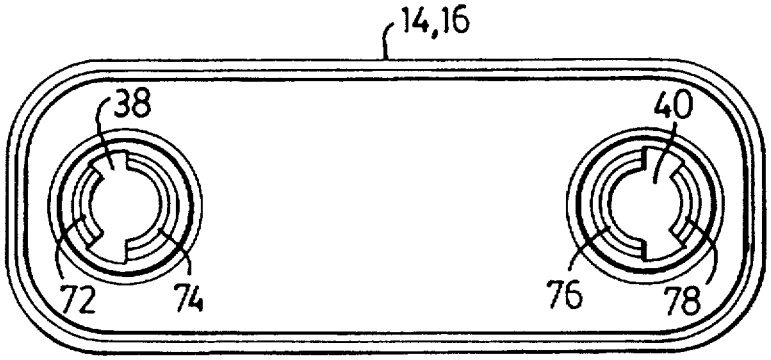

FIG. 12 is an embodiment similar to that of FIG. 10, but the diametrically opposed flange segments 72, 74 and 76, 78 are of different sizes, the inner flange segments 74, 76 being larger or wider than the outer flange segments 72, 78. This FIG. 12 embodiment provides a maximum flow restriction for the flow of fluid from inlet opening 38 to outlet opening 40.

It will be appreciated that other configurations for the flange segments can be chosen as well. The FIGS. 4 and 11 embodiments show the flange segments as being equi-spaced, but they could be spaced differently if desired. Fewer or more flange segments could also be provided than in the embodiments shown depending upon the particular flow restriction requirements, or the strengthening, or stress distribution requirements that are desired for heat exchanger 10.

Figure 9:
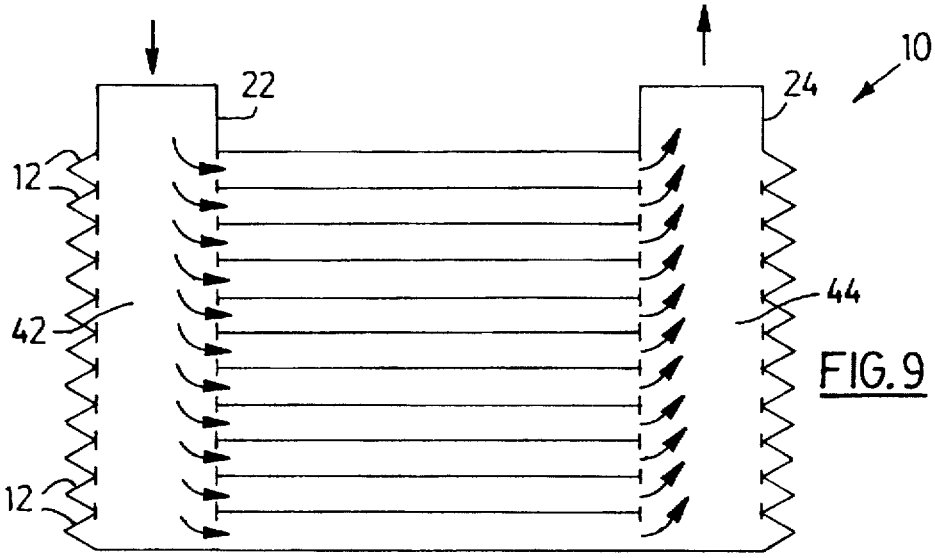
FIG. 9 is a diagrammatic view of the heat exchanger of FIG. 1 illustrating the variation in the flow resistance through the individual plate pairs making up the heat exchanger of FIG. 1.

Referring again to FIG. 9, fluid enters inlet manifold 42 and passes through the diagrammatically represented plate pairs 12 into outlet manifold 44. In this type of heat exchanger, the quantity of fluid flowing through the lower plate pairs 12 can be different than that through the plate pairs closer to the inlet and outlet nipples 22, 24 or to the fluid entry to inlet manifold 44 and the flow exit from outlet manifold 44. To compensate for this, or balance, or deliberately skew the flow through the various or selected plate pairs, the plate pairs can be made up of plates selected from those shown in FIGS. 4, 10, 11 and 12, so that there is a pre-determined flow restriction through selected plate pairs. For example, it may be desirable to have the minimum flow restriction through the plate pairs 12 closest to the fluid entry to inlet manifold 42 or at the top of the heat exchanger as shown in FIG. 9, and the maximum flow restriction in the lowermost plate pairs. To accomplish this, a FIG. 10 type plates could be used for the plate pairs near the top of heat exchanger 10, FIG. 4 plate pairs being located below that, FIG. 11 plate pairs being located below the FIG. 4 plate pairs, and finally the FIG. 12 plate pairs being located at the bottom, or vice versa. It will be appreciated that other combinations of the various plates described above could be employed to produce different flow patterns through heat exchanger 10 as desired.

Figure 6:
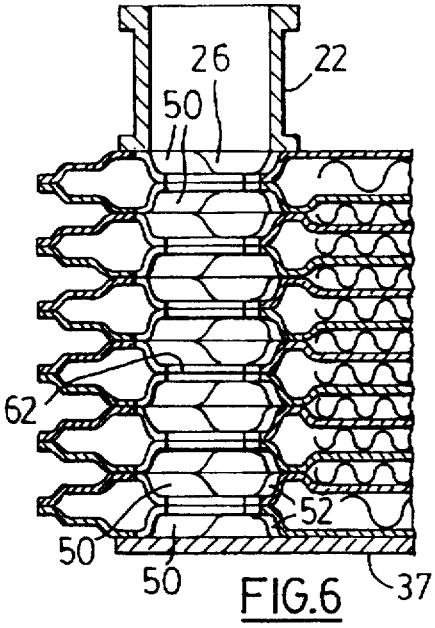
FIG. 6 is a partial sectional view of the heat exchanger of FIG. 1 as taken along lines 6—6 of FIG. 4.

The plate type heat exchanger described above, except for the joined flange segments on the peripheral edge portions of the inlet and outlet openings, is intended just to be illustrative. The present invention can apply to any type of plate type heat exchanger. FIG. 6 shows heat exchanger 10 having turbulizers or turbulators both inside the plate pairs and outside or between the plate pairs. One or both of these turbulizers could be eliminated or replaced by dimples, as will be apparent to those skilled in the art.

It will also be apparent to those skilled in the art that in light of the foregoing disclosure, many other alterations and modifications are possible in the practise of this invention without departing from the spirit or scope thereof. Accordingly, the scope of the invention is to be construed in accordance with the substance defined in the following claims.

What is claimed is:

1. A heat exchanger comprising:

a plurality of stacked plates arranged in face-to-face pairs, each of said face-to-face pairs including first and second plates, the first plate having a planar central portion, a lower peripheral co-planar edge portion extending below the central portion, and spaced-apart co-planar end bosses extending above the central portion;

the second plate of each face-to-face plate pair having a peripheral edge portion joined to said first plate peripheral edge portion, a central portion spaced from the first plate central portion, and spaced-apart co-planar end bosses extending below the second plate central portion;

the second plate of one plate pair being located back-to-back with a first plate of an adjacent plate pair, respective end bosses being joined together;

the end bosses defining inlet and outlet openings in registration, so that in a stack of back-to-back plate pairs, all inlet openings are in alignment and all outlet openings are in alignment forming respective inlet and outlet manifolds, said openings having inner peripheral edge portions; and said inner peripheral edge portions at the inlet and outlet openings of each plate pair including opposed, spaced-apart flange segments extending inwardly and being joined together.

2. A heat exchanger as claimed in claim 1 wherein the flange segments have radially disposed overlapping end portions.

3. A heat exchanger as claimed in claim 1 wherein the flange segments are joined together by being axially overlapped.

4. A heat exchanger as claimed in claim 1 wherein the flange segments are joined together in a butt joint.

5. A heat exchanger as claimed in claim 1 wherein each inner peripheral edge portion has a plurality of circumferentially spaced-apart flange segments.

6. A heat exchanger as claimed in claim 1 wherein each inner peripheral edge portion has two diametrically opposed flange segments.

7. A heat exchanger as claimed in claim 6 wherein one of said two diametrically opposed flange segments is larger than the other.

8. A heat exchanger as claimed in claim 1 wherein each inner peripheral edge portion has three equi-spaced flange segments.

9. A heat exchanger as claimed in claim 8 wherein the flange elements have radially disposed overlapping end portions.

10. A heat exchanger as claimed in claim 1 wherein each inner peripheral edge portion has a plurality of circumferentially spaced-apart flange segments, said flange segments being arranged to provide a predetermined flow restriction through the plate pairs, said flow restriction being different in selected plate pairs.

* * * * *